US012703559B2

(12) United States Patent
Bodet et al.

(10) Patent No.: US 12,703,559 B2
(45) Date of Patent: Aug. 11, 2026

(54) VALVE CUP FOR PRESSURE VESSEL

(71) Applicant: LINDAL FRANCE (SAS), Val-de-Briey (FR)

(72) Inventors: Hervé Bodet, Val-de-Briey (FR); Eric Gaillard, Val-de-Briey (FR)

(73) Assignee: LINDAL FRANCE (SAS), Val-de-Briey (FR)

( * ) Notice: Subject to any disclaimer, the term of this patent is extended or adjusted under 35 U.S.C. 154(b) by 162 days.

(21) Appl. No.: 18/726,348

(22) PCT Filed: Jan. 4, 2023

(86) PCT No.: PCT/EP2023/050115
§ 371 (c)(1),
(2) Date: Jul. 2, 2024

(87) PCT Pub. No.: WO2023/131621
PCT Pub. Date: Jul. 13, 2023

(65) Prior Publication Data

US 2025/0074690 A1 Mar. 6, 2025

(30) Foreign Application Priority Data

Jan. 6, 2022 (FR) ..... 2200078

(51) Int. Cl.
*B65D 83/44* (2006.01)
*B65D 83/14* (2025.01)
*B65D 83/16* (2006.01)

(52) U.S. Cl.
CPC ..... *B65D 83/44* (2013.01); *B65D 83/14* (2013.01); *B65D 83/164* (2025.01)

(58) Field of Classification Search
CPC ..... B65D 83/33; B65D 83/14; B65D 83/164; B65D 83/38; B65D 83/48
USPC ..... 222/635, 402.1, 630, 631
See application file for complete search history.

(56) References Cited

U.S. PATENT DOCUMENTS 3,854,636 A * 12/1974 Conway ..... B65D 83/44 222/402.24
6,296,156 B1 10/2001 Lasserre
10,562,697 B2 * 2/2020 Ramsey ..... B65D 83/44
(Continued)

FOREIGN PATENT DOCUMENTS

WO 2017021038 A1 2/2017
WO 2021013605 A1 1/2021

OTHER PUBLICATIONS

International Search Report and Written Opinion for PCT/EP2023/050115, mailed Apr. 4, 2023.

*Primary Examiner* — David J Walczak
(74) *Attorney, Agent, or Firm* — KDW Firm PLLC

(57) ABSTRACT

A valve cup for a pressurised container has an inner face oriented towards the inside of the container, and an outer face. The cup includes a deformable peripheral attachment zone configured to attach the cup to the container, a central opening configured to allow the passage of an outlet shaft of the product, and a bottom wall which surrounds the central opening and comprises a peripheral descending part and a central part. The central part includes a protective zone configured to limit deformation of the central part when the deformable attachment zone of the cup is deformed in order to attach the cup to the container.

17 Claims, 16 Drawing Sheets

(56) References Cited

U.S. PATENT DOCUMENTS

| | | | | |
|---|---|---|---|---|
| 2006/0102661 | A1* | 5/2006 | Scheindel | B65D 83/48<br>222/402.1 |
| 2019/0161268 | A1 | 5/2019 | Geier | |
| 2020/0087053 | A1 | 3/2020 | Geier | |

* cited by examiner

VALVE CUP FOR PRESSURE VESSEL

This application is a national stage filing under 35 U.S.C. 371 of pending International Application No. PCT/EP2023/050115, filed Jan. 4, 2023, which claims priority to French patent application 2200078, filed Jan. 6, 2022, the entirety of which applications are incorporated by reference herein.

FIELD OF THE INVENTION

The invention relates to a valve cup for a pressure container, as well as a valve consisting of such a cup.

BACKGROUND OF THE INVENTION

Valve cups are commonly used for pressure containers, particularly aerosol generators. A valve body is attached to the cup, forming an internal chamber in which there is a spring, a seal and, between the two, at least part of the obturator. The spring urges the obturator against the seal so that the valve is closed.

DISCLOSURE OF THE INVENTION

The valve cup is usually attached to the neck of a container by flaring, a method of attachment that involves creating an expansion of the valve cup using a mandrel or hydraulic pressure, resulting in plastic deformation of the valve cup. This deformation allows the cup to obtain a shape which substantially matches the internal shape of the neck of the container and thus to be attached to said neck. The inventor realised that plastic deformation during expansion is difficult to control and that the deformation does not always only take place in the direct vicinity of the neck but also in other parts of the valve cup. This causes a loss of mechanical resistance to pressure in the container and rupture hazard in the weld between the valve body and the valve cup.

The objective of certain embodiments is to design a valve cup which, when attached to the pressure container, for example by flaring, makes it possible to better control plastic deformation, and in particular to protect the central part of the cup, and more particularly to protect the attachment between the valve body and the valve cup.

According to a first aspect of the invention, there is proposed a valve cup for a pressure container, having an inner face turned towards the inside of the container, and an outer face. The cup is provided with a peripheral deformable attachment area configured for attaching the cup onto the container, a central opening configured for allowing passage of a product outlet rod, and a bottom wall which surrounds the central opening and comprises a peripheral descending part and a central part. The bottom wall comprises a central part provided with a protection area configured for limiting the deformation of the central part during the deformation of the deformable attachment area of the cup for attaching the cup onto the container.

In this way, when the cup is attached to the container, for example by flaring at its neck, the protection area makes it possible to limit the deformation of the central part, while the deformable attachment area substantially matches the shape of the neck. Due to the presence of the protection area, the central part need not be particularly resistant, since it is subject to less effort during attachment of the cup to the container.

Furthermore, even if the central part is slightly deformed when attaching the cup to the container and/or when pressurising the container, the angles between the different portions of the bottom wall remain substantially identical. In particular, the negative angle of the peripheral descending part remains substantially identical, limiting the loss of mechanical resistance to pressure within the container. Indeed, in a traditional valve cup, this angle can decrease in absolute value, approaching zero, or even become positive, due to the deformation of the valve cup, which causes a loss of mechanical resistance to pressure in the container.

According to a preferred embodiment, the central part is provided with a planar wall surrounded by the protection area, including the central opening and configured for receiving a valve body on the inner face.

In other words, the inner face of the valve cup may be used for attaching a valve body to the valve cup, in particular by gluing or welding the valve body to the planar wall of the central part of the cup. The welding may be carried out by any appropriate means, in particular by ultrasonic welding or by rotation welding. Thus, by limiting the deformation of the central part, the protection area protects the attachment between the valve body and the valve cup and thus prevents the valve body from becoming detached from the valve cup.

According to a preferred embodiment, the deformable attachment area comprises a deformable descending wall, preferably with an essentially vertical slope, and a bearing edge.

The deformable descending wall may be substantially cylindrical, or slightly frustoconical. It allows on the one hand to keep the central opening away from the end of the deformable attachment area by helping to make deeper the cavity defined by the cup, and on the other hand to attach the cup to the neck of the container, particularly in the case of flaring. The deformable attachment area allows the cup to be placed on the neck of the container. The outer diameter of the cup may be greater than the diameter of the neck so that the cup does not fall into the container. In the case of flared cups, the neck of the container is generally rolled and the deformable attachment area surrounds the internal part of the neck. In this case, the deformable attachment area substantially matches the shape of the neck by enveloping the internal part of the neck.

According to a preferred embodiment, the protection area comprises a rising and/or descending wall which protrudes from the peripheral descending part. When the rising and/or descending wall corresponds to a rising wall, the rising wall may be configured for surrounding an attachment crown of a valve body.

The rising and/or descending wall may be substantially cylindrical, or slightly frustoconical. On the one hand it allows to isolate the central part of the deformable attachment area, and on the other hand it serves as a centering means to centre the valve body, particularly when attaching the crown of the valve body onto the inner face of the planar wall of the central part. Thus, the rising and/or descending wall makes it possible to protect the attachment between the crown of the valve body and the valve cup by limiting the deformation of the central part, in particular that of the planar wall of the central part, and thus to prevent the valve body from becoming detached from the valve cup.

According to a preferred embodiment, the bottom wall comprises a bend between the peripheral descending part and the rising and/or descending wall.

This bend allows for a discontinuous junction between the peripheral descending part and the central part, and the central part is thus protected due to the limited deformation of the central part during attachment of the cup onto the container, and the negative angle of the peripheral descending part is also maintained at a substantially constant value before and after attachment of the cup onto the container.

According to an exemplary embodiment, the rising and/or descending wall is a rising wall, and an angle between the peripheral descending part and the rising wall is less than 90°, preferably between 50° and 85°, more preferably between 60° and 80°.

According to another exemplary embodiment, the rising and/or descending wall is a descending wall, and an angle between the peripheral descending part and the descending wall is greater than 90°, preferably between 95° and 140°, more preferably between 100° and 120°.

Thus, whether the wall mentioned in the two exemplary embodiments above is a rising or a descending wall, said wall makes it possible to isolate the central part of the deformable attachment area, and therefore to protect the attachment between the crown of the valve body and the valve cup by limiting the deformation of the central part.

According to a preferred embodiment, the bottom wall comprises a turned-up edge forming a rolled edge surrounding the central opening. The edge of the bottom wall which surrounds the central opening may be continuous with the rising and/or descending wall when this rising and/or descending wall is frustoconical or, if the bottom wall comprises a planar wall, the edge may be continuous with said planar wall.

It may prove useful to turn up the edge of the bottom wall which surrounds the central opening to prevent the border of the cup at the central opening from being in contact with, for example, a remainder of the product contained in the pressure container which would have fallen into the cup. For this, provision can be made for the edge of the bottom wall which surrounds the central opening to be turned up, preferably in the direction of the outer face of the cup, to form a rolled edge. Thus, the border of the cup surrounding the central opening is located at a distance from, preferably above, the bottom wall.

According to an exemplary embodiment, the edge is turned up a first time in the direction of the outer face of the cup, and a second time in the direction of the inner face of the cup.

In this way, this eliminates any mistake made by welding the product outlet rod to the upturned edge, since the outlet rod is in contact with the outer face of the cup rather than with its inner face. In addition, in the case of a metallic outer face, corrosion of the upturned edge is avoided by the presence of an annular valve seal around the central opening, thus increasing the lifespan of the cup and ensuring tightness between the cup and the valve body.

According to an exemplary embodiment in which the central part is provided with a planar wall as described above, the edge forms an angle of between 70° and 110°, preferably between 80° and 100°, with respect to the planar wall.

According to an exemplary embodiment, the peripheral descending part comprises a concave outer face.

The shape of the peripheral descending part may be such that its inner face is convex, therefore its outer face is concave. In this way, the cup better resists the pressure within the container. Furthermore, in the case of a cup comprising a polymer material or made entirely of this material, vertical and radial reinforcing ribs on at least one of the faces of the cup, preferably the outer face, may be provided to reinforce the cup.

According to an exemplary embodiment, the concave outer face has a radius of curvature of between 4 and 20 mm, preferably between 5 and 15 mm.

According to another exemplary embodiment, the peripheral descending part comprises a planar frustoconical outer face.

The inclination of the frustoconical part allows on the one hand to keep the central opening away from the deformable attachment area and on the other hand allows the cup to resist the pressure within the container. The inclination of the frustoconical part may be chosen as a function of said pressure and the distance desired to separate the central opening from the deformable attachment area, in other words as a function of the depth of the cup cavity.

According to yet another exemplary embodiment, the peripheral descending part comprises a first portion with a concave outer face as well as a second portion with a planar frustoconical outer face.

According to a preferred embodiment, the deformable attachment area has a height at least three times greater than the height of the peripheral descending part.

According to a preferred embodiment, the height of the peripheral descending part is greater than the height of the rising and/or descending wall. Height is measured parallel to the centreline of the valve cup.

According to an exemplary embodiment in which the central part is provided with a planar wall as described above and in which the protection area comprises a rising and/or descending wall as described above, the planar wall forms an angle of between 70° and 110°, preferably between 80° and 100°, with respect to the rising and/or descending wall.

According to a preferred embodiment, the end of the deformable attachment area is substantially horizontal.

In other words, the deformable attachment area, in particular the bearing edge, does not fall again in the form of an outer skirt after having reached its top. This saves material by eliminating the annular cavity traditionally used to wrap the neck of the container beyond the top of the neck.

According to a preferred embodiment, the deformable attachment area comprises a frustoconical part.

This frustoconical part has the particular advantage of facilitating the attachment of the cup onto the neck of the pressure container.

According to a second aspect of the invention, a valve is proposed consisting of a cup according to one of the embodiments described above, and a valve body with a product outlet rod, the valve body being attached to the inner face of the cup, with the rod passing through the central opening of the cup.

According to a preferred embodiment, the valve body is welded or glued to the inner face of the central part of the bottom wall.

In the case where the protection area surrounds an attachment crown of the valve body, the annular border (upper face) of the attachment crown is preferably provided with at least one extra thickness of material going completely around the crown and serving as an energy director during ultrasonic welding of the valve body to the cup. In this way, the protection area protects the attachment between the valve body and the valve cup and thus prevents the valve body from becoming detached from the valve cup.

According to a preferred embodiment, the valve body comprises a spring, an obturator and a valve seal.

The spring urges the obturator against the seal so that the valve is closed. Tightness between the cup and the valve body is therefore ensured by the valve seal crushed against the inner face of the cup, forming an annular seal all around the central opening. The weld at the interface between the attachment crown and the cup therefore need not be watertight. It must only hold the valve body against the cup against the action of the spring and ensure good seating of the valve seal against the inner face of the cup. It is therefore possible that the weld is not continuous.

According to a third aspect of the invention, there is proposed a valve cup for a pressure container, having an inner face turned towards the inside of the container, and an outer face. The cup is provided with a peripheral deformable attachment area configured for attaching the cup onto the container, a central opening configured for allowing passage of a product outlet rod, and a bottom wall which surrounds the central opening and comprises a peripheral descending part and a central part. The central part includes a rising and/or descending wall which protrudes from the peripheral descending part.

In a preferred embodiment, when the rising and/or descending wall corresponds to a rising wall, the rising wall is configured for surrounding an attachment crown of a valve body.

Those skilled in the art will understand that the advantages which are described above in relation to the valve cup according to the aforementioned embodiments and which are the subject-matter of the first aspect of the invention also apply to the valve cup which is the subject-matter of the third aspect of the invention.

The objective of other embodiments is to design a valve cup which is economical to manufacture and which, when attached to a valve body, for example by welding, allows for a better alignment of the central opening of the valve cup with the internal chamber of the valve body.

According to a fourth aspect of the invention, there is proposed a valve cup for a pressure container, having an inner face turned towards the inside of the container, and an outer face. The cup is provided with a peripheral deformable attachment area configured for attaching the cup onto the container, a central opening configured for allowing passage of a product outlet rod, and a bottom wall which surrounds the central opening and comprises a peripheral descending part and a central part. The central part is provided with a centering means configured for centering a valve body during attachment of the valve body onto the inner face of the central part.

In this way, when the cup is attached onto the valve body, the centering means makes it possible to centre the valve body so that the central opening of the valve cup is aligned with the internal chamber of the valve body.

According to an exemplary embodiment, the centering means is a continuous peripheral wall formed in the central part.

According to another exemplary embodiment, the centering means is composed of a plurality of protrusions spaced from each other.

This saves material by eliminating the material that would be used if the centering means were continuous. More material can be saved by reducing the number of protrusions and/or their dimensions.

According to a preferred embodiment, the central part is provided with a planar wall including the central opening and surrounded by the centering means, configured for receiving a valve body on the inner face.

According to an exemplary embodiment, the centering means is a protection area configured for limiting the deformation of the central part during the deformation of the deformable attachment area of the cup for attaching the cup onto the container.

According to an exemplary embodiment, the centering means is a rising wall which protrudes from the peripheral descending part.

The rising wall may be substantially cylindrical, or slightly frustoconical. It serves as a centering means for centering the valve body, particularly when attaching the crown of the valve body onto the inner face of the planar wall of the central part. Indeed, the valve body can occupy the space of the cavity defined by the rising wall and the central part of the bottom wall towards the inner face so as to be centred before being attached to the valve cup.

Those skilled in the art will understand that the centering means forming the subject-matter of the fourth aspect of the invention may be combined with all the embodiments of the first or the third aspect of the invention.

BRIEF DESCRIPTION OF THE FIGURES

These and other aspects of the present invention will now be described in more detail, with reference to the accompanying drawings showing exemplary embodiments of the invention. Like numbers refer to like features in all drawings.

DETAILED DESCRIPTION OF THE INVENTION

Figure 1:
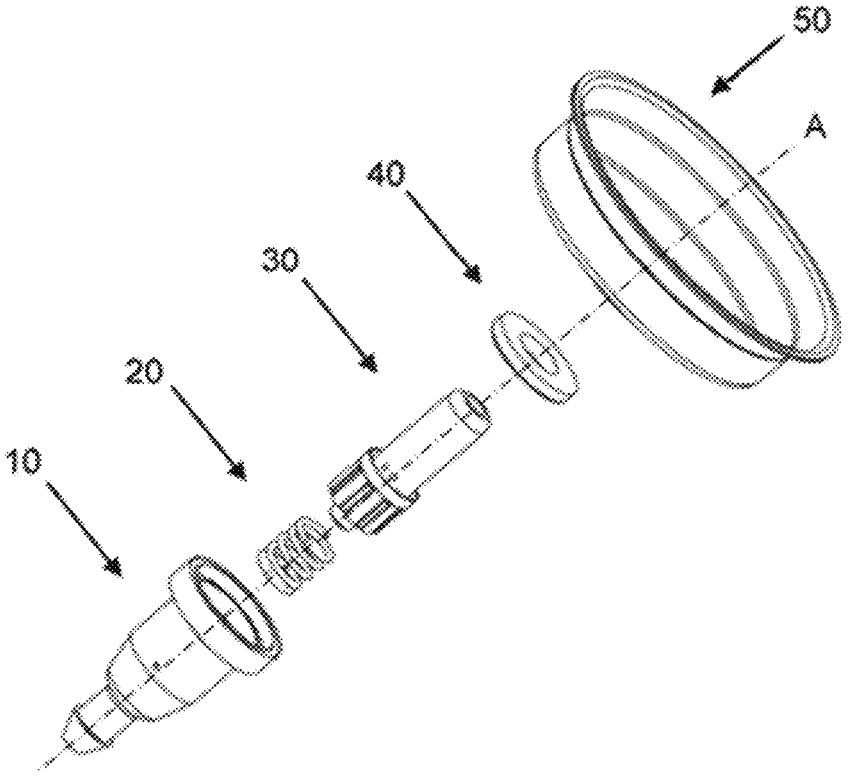
FIG. 1 illustrates an exploded view of a male-type valve provided with a cup according to one embodiment of the invention.

FIG. 1 schematically illustrates an exploded view of a male-type valve provided with a cup according to one embodiment of the invention.

FIG. 1 illustrates a valve cup for a valve 1 intended for use in a pressure container. The valve 1 consists mainly of a cup 50 and a valve body 10 in which a spring 20, an obturator 30 and a valve seal 40 are placed.

Valves with obturators are sealed by an obturator 30 which must be moved away from the valve seal 40 to allow the product to exit the valve. The product leaves valve 1 through a small tube, herein designated as a stem or rod, which passes through a central opening in the cup.

Valve 1 can be used in all positions. In the figures illustrating this application, the valve is shown with the stem, or the access opening to the female valve, pointing upwards. The references "top"/"bottom", "up"/"down", or "upper"/"lower" only have a relative value in relation to the representations in the attached figures. It goes without saying that the valve can be used in all positions and what is up in the position shown here will not necessarily be up in use. Furthermore, the valve extends longitudinally relative to a main axis A, which is a vertical axis in the representations of the attached figures. Terms "radial", "axial" and "transverse" relate to this main axis A.

As with any cup valve, the cup 50 constitutes a separation between the side of the valve intended to be placed inside the container and the other side intended to be outside the container. Terms "inner" and "outer" refer to elements located on the inner side or outer side of the cup. Terms "internal" and "external" refer to a particular component (specifically the valve body) and define what is inside or outside said component, regardless of whether it is a component located on the inner side or outer face of the cup.

Figure 2A:
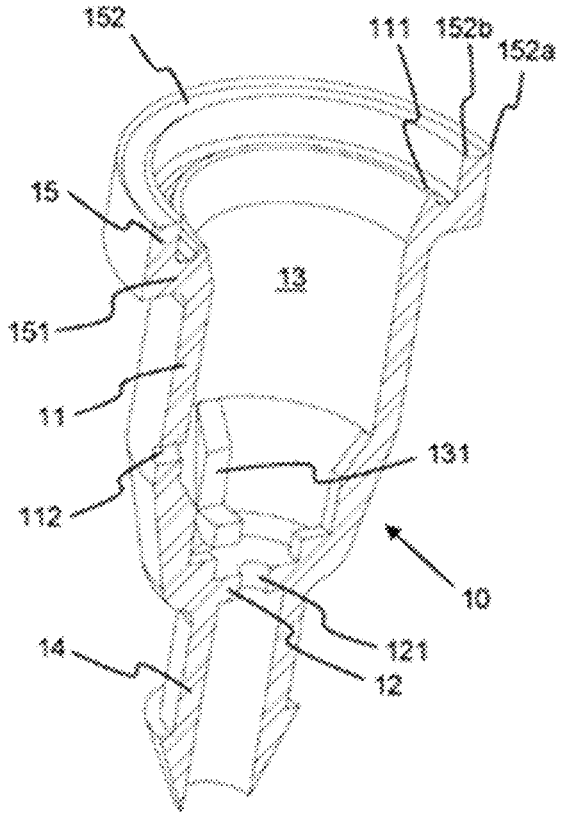
FIGS. 2A and 2B respectively illustrate a sectional and perspective view of the valve body of the valve of FIG. 1, and of the male valve stem.
Figure 2B:
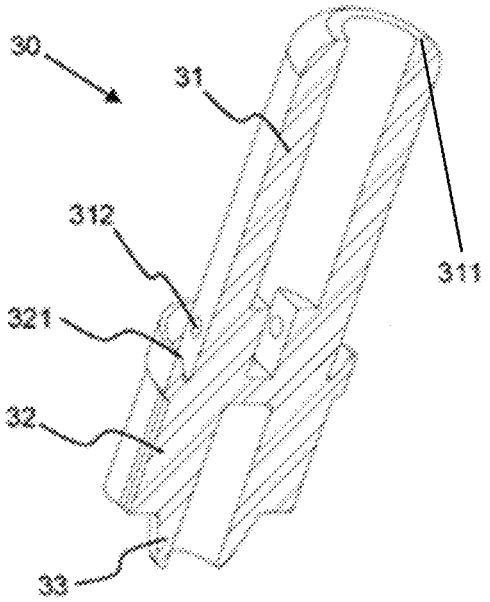

FIGS. 2A and 2B schematically illustrate a sectional and perspective view of the valve body of the valve of FIG. 1, and of the male valve stem, respectively.

The valve body 10 mainly consists of a tubular body 11 partially closed at a first end, herein designated as the lower end, by a bottom wall 12 having an inlet 121. The tubular body 11 and the bottom wall 12 define together an internal chamber 13. Vertical ribs 131 may be provided at the bottom of the internal chamber, close to the bottom wall. These ribs project radially from the tubular body towards the centre of the internal chamber, forming an accommodating space in which a first end of the spring 20 can be accommodated and radially retained. An attachment stud 14 may be provided on the external face of the bottom wall 12 for attaching, for example, a dip tube or anti-sagging means. This stud 14 is tubular in shape and surrounds the inlet 121.

To save material, it is preferable for the wall of the tubular body 11 to narrow in the part carrying the vertical ribs 131. In particular, this part may be frustoconical. Thus, the tubular body 11 and the internal chamber 13 essentially consist of a cylindrical upper part continuing downwards into a tapering part (here frustoconical) closed at the bottom by the bottom wall 12. In the valve bodies of the state of the art, the tubular wall and the internal chamber remain cylindrical down to the bottom wall. This tapered part helps to reduce the cost of manufacturing the valves of the invention. At least one opening 112 may be provided in the tubular body 11, which opening forms a passage bringing the external face and the internal face of the tubular body into contact. This opening, which is optional, serves as an additional gas intake to improve the quality of the spraying.

The second end of the tubular body 11 ends in a tapered edge 111. It is surrounded by an attachment crown 15 which consists of a tubular wall connected to the second end of the tubular body by a transverse wall 151. This transverse wall for example is parallel to a plane perpendicular to the main axis A. It may be solid as in the present example or crenellated if it is not necessary to ensure a seal between the two faces of this transverse wall. The annular border (upper face) 152 of the attachment crown 15 is preferably provided with at least one extra thickness of material going completely around the crown and serving as an energy director during ultrasonic welding of the valve body on the cup. In the example shown here, there are two rings of extra thickness of material 152*a*, 152*b*.

The stem 30 is of usual shape. It consists of a cylindrical wall 31 open at its upper end 311 and closed at its lower end, forming a product outlet channel. One or more holes 312 placed at the bottom of the outlet channel extend radially through the cylindrical wall to bring the internal face and the external face of said cylindrical wall 31 into contact. The cylindrical wall 31 constitutes the product outlet rod. This cylindrical wall continues into the part serving as an obturator, which comprises a crown 32 of larger diameter having on its external face vertical channels or vertical ribs allowing the product to bypass the crown. The outer shell of this crown has a diameter slightly smaller than the internal diameter of the tubular body 11 of the valve body so that it can enter the latter while being guided. On its upper annular face, the crown 32 is provided with a sealing rib 321 to ensure tightness with the valve seal 40. The crown 32 continues downwards into a guide stud 33 configured for cooperating with the second end of spring 20. The seat of female valves and the grommet of high-flow valves are also of usual shape.

Figure 3:
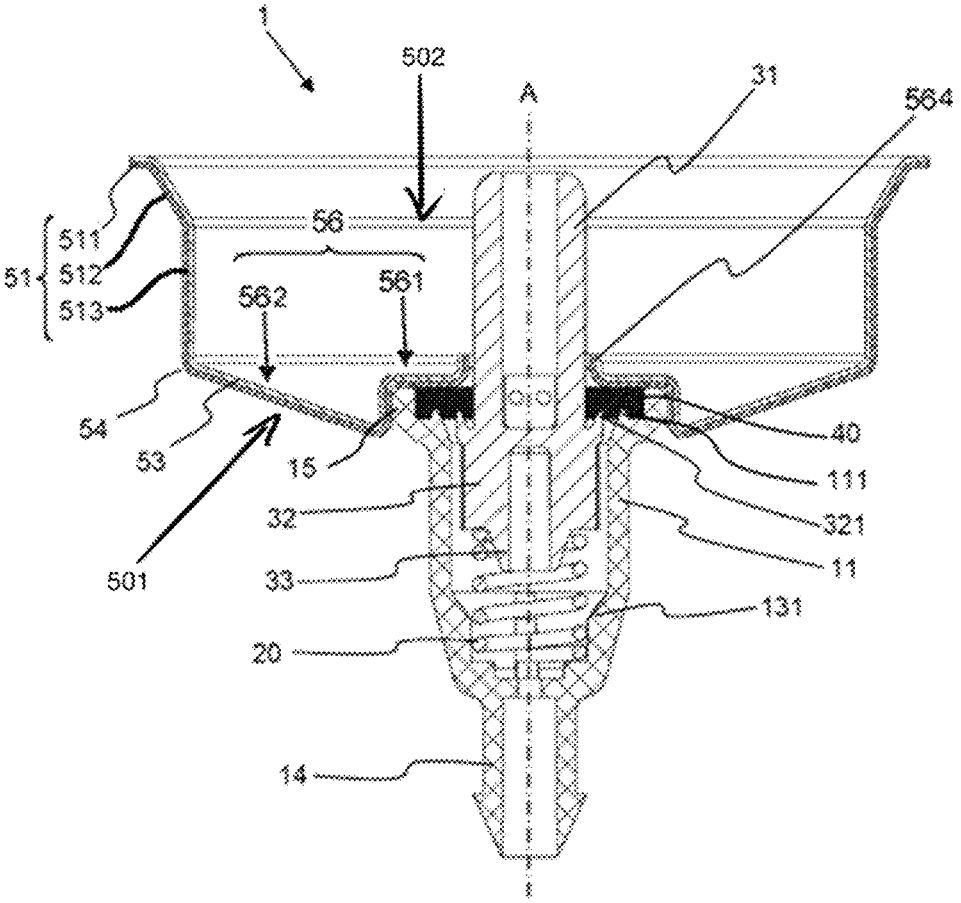
FIG. 3 illustrates a sectional view of the valve of FIG. 1.
Figure 4:
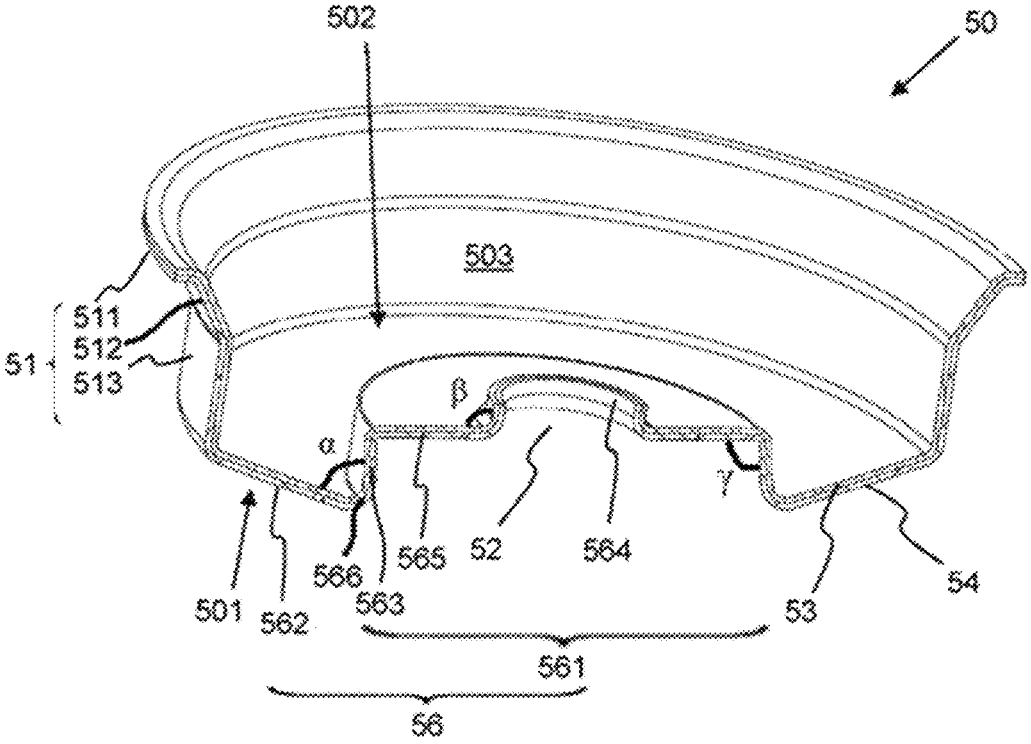
FIG. 4 illustrates a sectional and perspective view of the valve cup of FIG. 1.

FIG. 3 schematically illustrates a sectional view of the valve of FIG. 1. FIG. 4 schematically illustrates a sectional and perspective view of the valve cup of FIG. 1.

The valve cup 50 for a pressure container 60 has an inner face 501 turned towards the inside of the container 60, and an outer face 502. The valve cup 50 is provided with a peripheral deformable attachment area 51 configured for attaching the cup 50 on the container (not shown, see element 60 in FIG. 10), a central opening 52 configured for allowing passage of a product outlet rod, and a bottom wall 56 which surrounds the central opening 52 and comprises a peripheral descending part 562 and a central part 561. The bottom wall 56 comprises a central part 561 provided with a protection area configured for limiting the deformation of the central part 561 during the deformation of the deformable attachment area 51 of the cup for attaching the cup onto the container 60.

The central part 561 may be provided with a planar wall 565 surrounded by the protection area, including the central opening 52 and configured for receiving a valve body 10 on the inner face 501. The deformable attachment area 51 may include a deformable descending wall 513, preferably with an essentially vertical slope, and a bearing edge 511. The deformable descending wall 513 may be substantially cylindrical as illustrated in FIGS. 3 and 4, or slightly frustoconical. It makes it possible on the one hand to keep the central opening 52 away from the end of the deformable attachment area 51 by helping to make deeper the cavity 503 defined by the cup 50, and on the other hand to attach the cup 50 to the neck 61 of the container 60, particularly in the case of flaring.

The protection area may comprise a rising and/or descending wall 563 configured for surrounding an attachment crown 15 of a valve body 10, as illustrated in FIG. 3. The rising and/or descending wall 563 may protrude from the peripheral descending part 562. The rising and/or descending wall may be substantially cylindrical as illustrated in FIGS. 3 and 4, or slightly frustoconical. It makes it possible on the one hand to isolate the central part 561 from the deformable attachment area 51, and on the other hand, it serves as a centering means for centering the valve body 10, in particular when attaching the crown 15 of the valve body 10 onto the inner face 501 of the planar wall 565 of the central part 561. Indeed, the valve body 10 can occupy the space of the cavity defined by the rising wall 563 and the planar wall 565 towards the inner face 501 so as to be centred before being attached to the valve cup 50.

The bottom wall 56 may include a bend 566 (see FIG. 4) between the peripheral descending part 562 and the rising and/or descending wall 563. The rising and/or descending wall 563 may correspond to a rising wall 563 as illustrated in FIGS. 3 and 4. An angle α between the peripheral descending part 562 and the rising wall 563 may be less than 90°, preferably between 50° and 85°, more preferably between 60° and 80°. This angle α is measured from the outer face's 502 side.

The bottom wall 56 may include a turned-up edge 564 forming a rolled edge surrounding the central opening 52. The edge 564 of the bottom wall 56 which surrounds the central opening 52 may be continuous with the planar wall 565. The edge 564 may form, relative to the planar wall 565, an angle β of between 70° and 110°, preferably between 80° and 100°. This angle β is measured from the outer face's 502 side.

The peripheral descending part 562 may comprise a planar frustoconical outer face as illustrated in FIGS. 3 and 4. The deformable attachment area 51 may have a height at least three times greater than the height of the peripheral descending part 562. The height is measured parallel to the main axis A. The height of the peripheral descending part 562 may be greater than the height of the rising and/or descending wall 563, as illustrated in FIG. 3. Alternatively, the height of the peripheral descending part 562 may be less than the height of the rising and/or descending wall 563, as illustrated in FIG. 4.

As illustrated in FIG. 4, the planar wall 565 may form, relative to the rising and/or descending wall 563, an angle γ of between 70° and 110°, preferably between 80° and 100°. This angle γ is measured from the inner face's 501 side.

The end of the deformable attachment area 51 may be substantially horizontal. The peripheral end of the deformable attachment area 51 may be in the form of a planar ring as illustrated in FIGS. 3 and 4 and/or a ring whose wall is inclined towards the centre of the cup 50. In other words, the end of the deformable attachment area 51 does not fall again after having reached its highest point.

For example, the deformable descending wall 513 may be frustoconical, as illustrated in FIGS. 3 and 4, or partially toroidal. Its inner face 501 preferably has substantially the dimensions and shape of the neck 61 of the container 60 with which it is to be used. In other words, the deformable attachment area 51, in particular the bearing edge 511, does not fall again in the form of an outer skirt after having reached its top. The deformable attachment area 51 may comprise a frustoconical part 512. This frustoconical part 512 has the particular advantage of facilitating the attachment of the cup 50 onto the neck of the container (not shown, see elements 60 and 61 in FIG. 10).

The cup 50 may be made entirely of polymer. It is also possible that it consists, as in the present example, of an outer metallic layer 53 and an inner layer 54 of polymer. For example, we could choose a metal and polymer laminate. In particular, a laminate of 0.25 mm steel and 200 μm PP is particularly well suited to the invention. The inner face 501 of the cup may be provided with a layer 54 which can serve as a seal. For example, this layer 54 may be made of polymer, preferably polypropylene or other polyolefin (PE, PET, TPE), which may be a virgin, recycled or biosourced material, a food-grade material or not, and a pharmaceutical-grade material or not. This is helpful on the one hand to serve as a seal if the cup is attached to the container 60 by flaring, and on the other hand to weld a valve body onto the inner face of the cup. In such a case, tightness is ensured essentially at the interface between the inner face and the inside of the neck at the position where flaring is carried out. It is therefore not necessary to exert as great a force on the cup during flaring as in the case where a specific seal is provided between the cup and the neck of the container. The outer face 502 of the cup may be provided with a metallic layer 53, preferably made of aluminium or tinplate. This allows the cup to be attached by flaring. In addition, this metal layer gives the cup sufficient rigidity to withstand the pressure in the pressure container 60. If necessary, reinforcing ribs may be provided on at least one face of the cup, preferably the outer face.

A space may be provided between the valve cup 50 and the attachment crown 15 of the valve body 10, as illustrated in FIG. 3. This space has the particular advantage of allowing the attachment crown 15 to vibrate freely when welding the valve body 10 to the valve cup 50.

Figure 5:
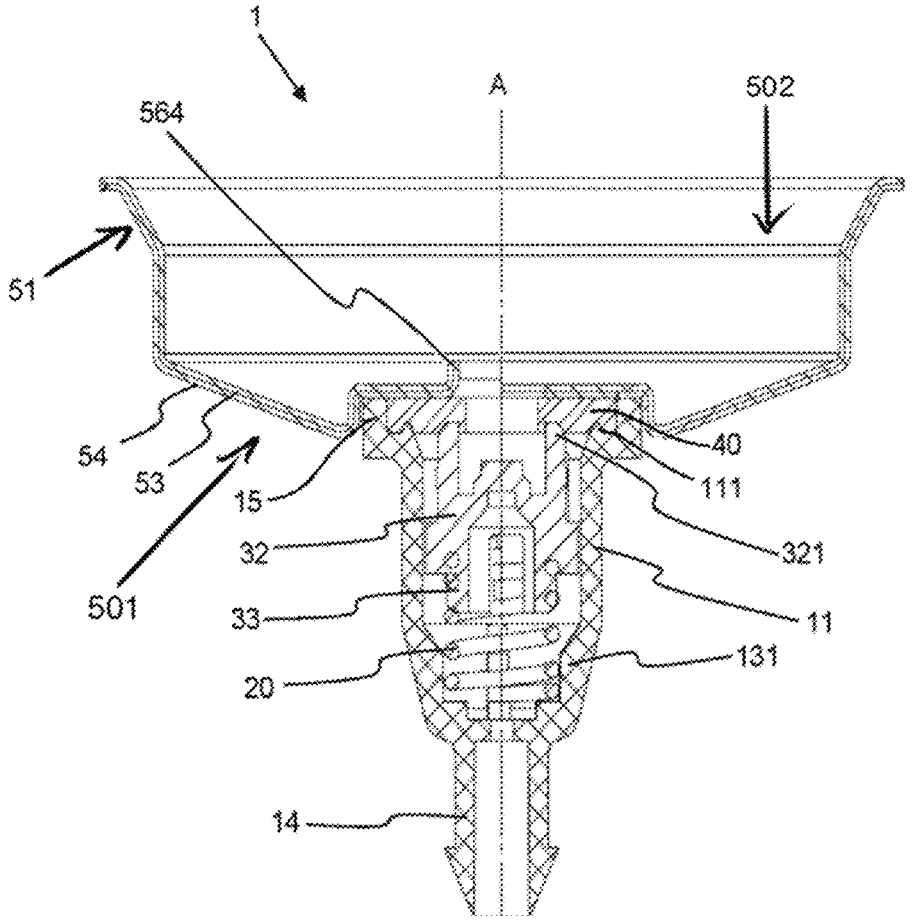
FIG. 5 illustrates a sectional view of a female-type valve provided with a cup according to one embodiment of the invention.
Figure 6:
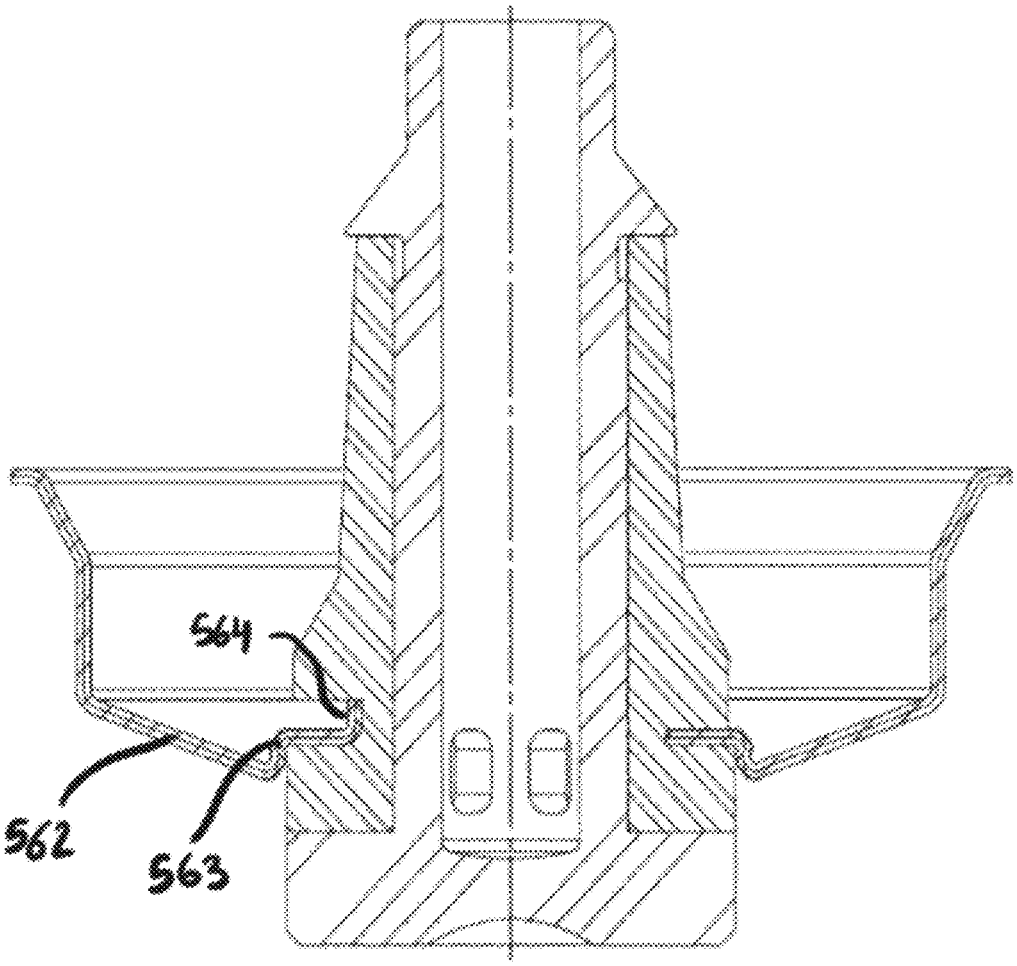
FIG. 6 illustrates a sectional view of a high-flow type valve provided with a cup according to one embodiment of the invention.

FIG. 5 schematically illustrates a sectional view of a female-type valve provided with a cup according to one embodiment of the invention, showing a cup with a rolled central edge on the left, and a cup with a simple central edge on the right. FIG. 6 schematically illustrates a sectional view of a high-flow type valve provided with a cup according to one embodiment of the invention, showing a cup with a rolled central edge on the left, and a cup with a simple central edge on the right.

Similar components have been indicated by the same reference numerals as in previous embodiments and will not be described again.

The embodiments shown in FIGS. 3, 7, 10 and 13 correspond to male-type valves in which the obturator is an integral part of stem 30, with a part of the stem 31 projecting out of the valve. As shown in FIG. 5, the invention can also be applied to a female-type valve having as an obturator a seat which is located in the valve body 10 and which must be actuated by an outer rod (generally that of a dispenser) entering the valve through the central opening 52. The invention can also be used for a high-flow type valve like that illustrated in FIG. 6.

Figure 7:
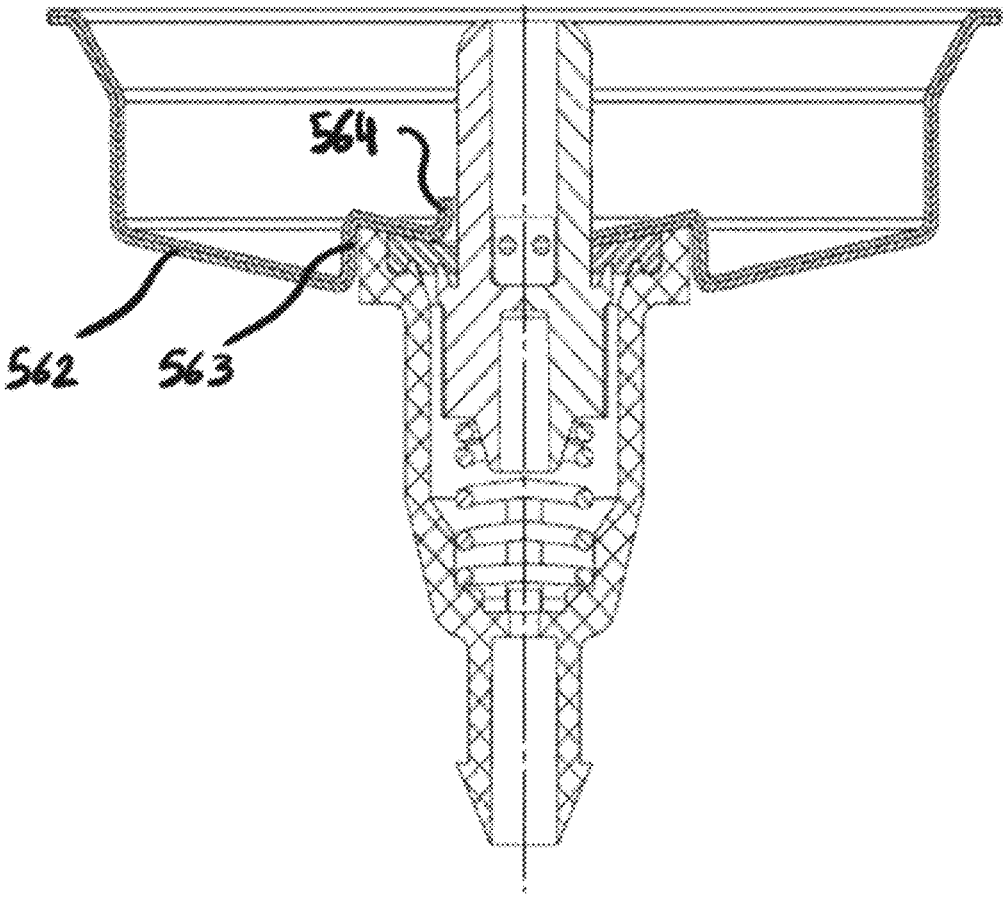
FIG. 7 illustrates a sectional view of a male-type valve provided with a cup according to an alternative embodiment of the invention.

FIG. 7 schematically illustrates a sectional view of a male-type valve provided with a cup according to an alternative embodiment of the invention in which the central part comprises a rising wall followed by a frustoconical descending wall, showing a cup with a rolled central edge on the left, and a cup with a simple central edge on the right.

As illustrated in FIG. 7, the rising and/or descending wall 563 may comprise a first rising wall which protrudes from the peripheral descending part 562, followed by a frustoconical descending wall. The central edge 564 of the bottom wall 56 which surrounds the central opening 52 may be continuous with the frustoconical descending wall.

Figure 8A:
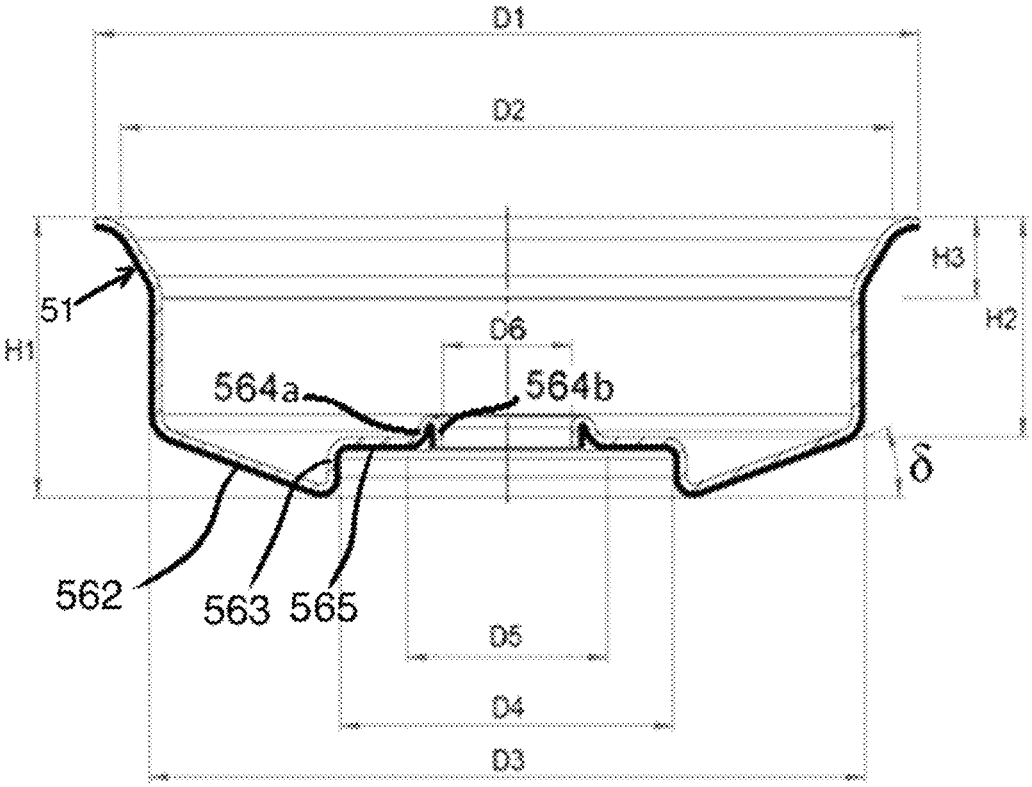
FIGS. 8A and 8B illustrate a sectional view of a cup according to one embodiment of the invention before flaring (FIG. 8A) and after flaring (FIG. 8B)
Figure 8B:
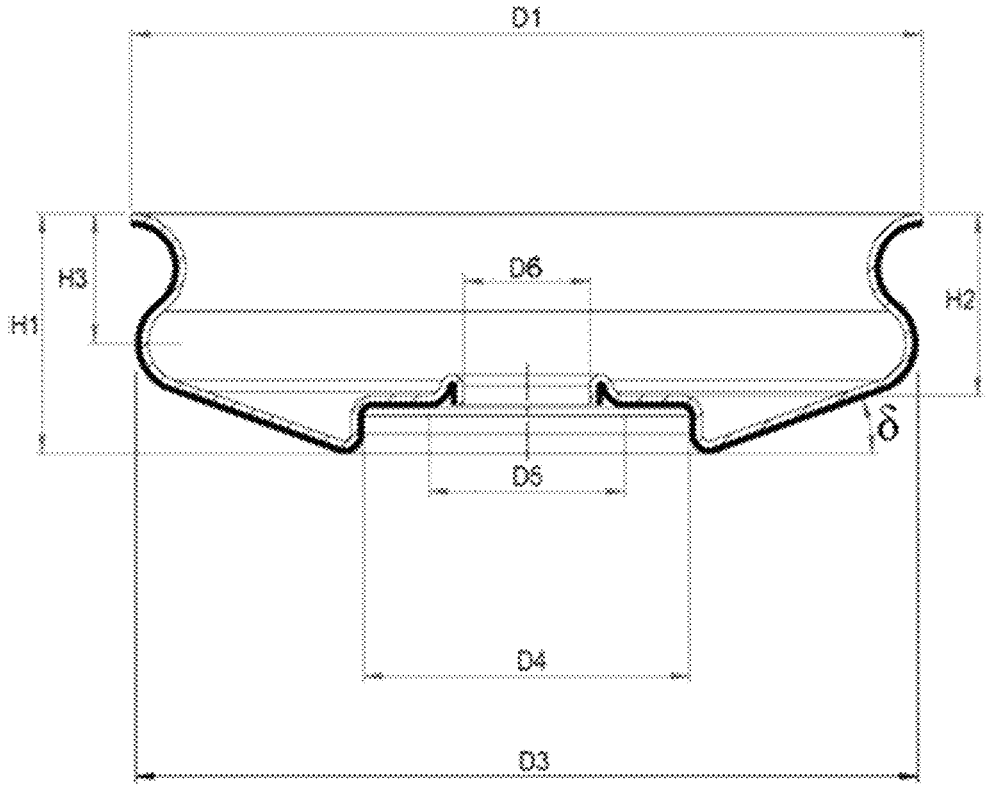

FIGS. 8A and 8B schematically illustrate a sectional view of a cup according to one embodiment of the invention before flaring (FIG. 8A) and after flaring (FIG. 8B).

As illustrated in FIGS. 8A and 8B, the peripheral descending part 562 may comprise a planar frustoconical outer face 502. When the cup 50 is attached to the container 60, for example by flaring at its neck 61, the protection area limits the deformation of the central part 561, while the deformable attachment area 51 substantially matches the shape of the neck 61, which is illustrated by the shape that the cup 50 takes after flaring in FIG. 8B compared to that which it had before flaring in FIG. 8A.

The peripheral descending part 562 may have a negative angle δ, in other words a descent angle, of between 10 and 30 degrees, preferably between 15 and 25 degrees. Even if the central part 561 is slightly deformed when the cup 50 is attached to the container 60 and/or when the container 60 is pressurised, the angles between the different portions of the bottom wall 56 remain substantially identical. In particular, as shown in FIGS. 8A and 8B, the negative angle δ of the peripheral descending part 562 remains substantially identical after flaring, which makes it possible to limit the loss of mechanical resistance to pressure within the container 60.

With reference to FIGS. 8A and 8B, the edge 564 may be turned up a first time in the direction of the outer face 502 of the cup 50, and a second time in the direction of the inner face 501 of the cup 50.

Figure 9A:
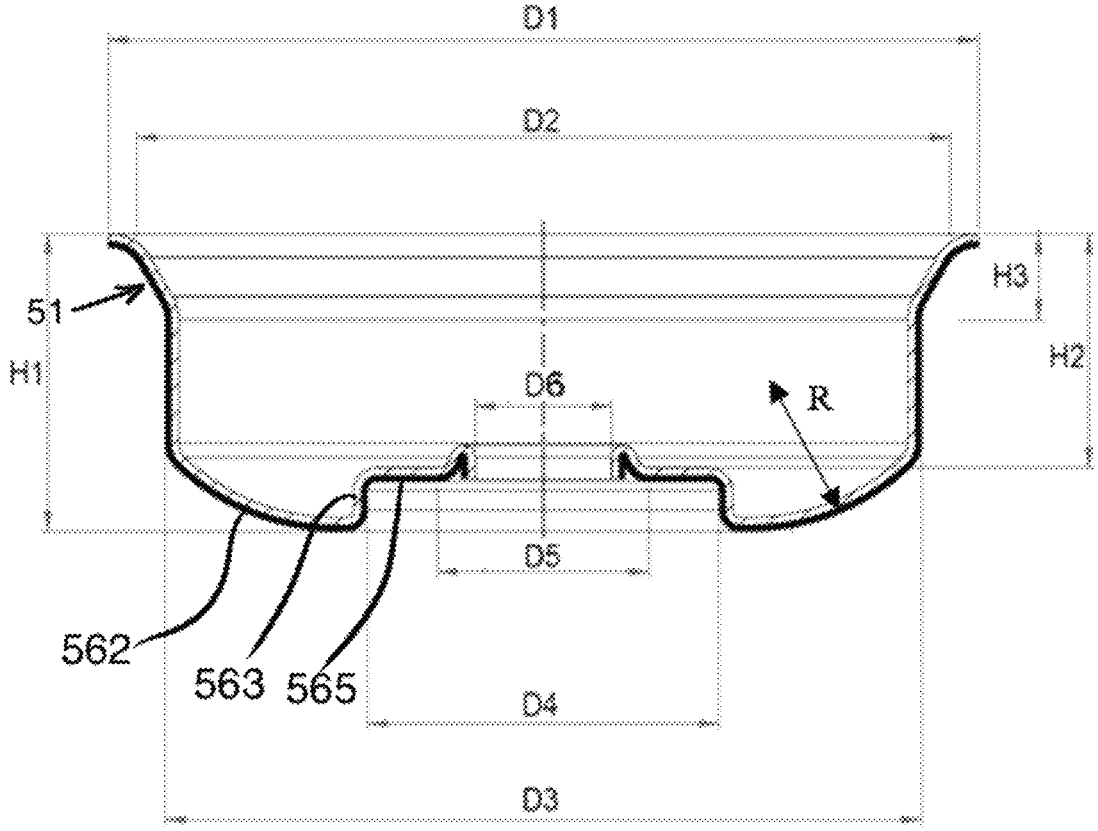
FIGS. 9A and 9B illustrate a sectional view of a cup according to an alternative embodiment of the invention before flaring (FIG. 9A) and after flaring (FIG. 9B)
Figure 9B:
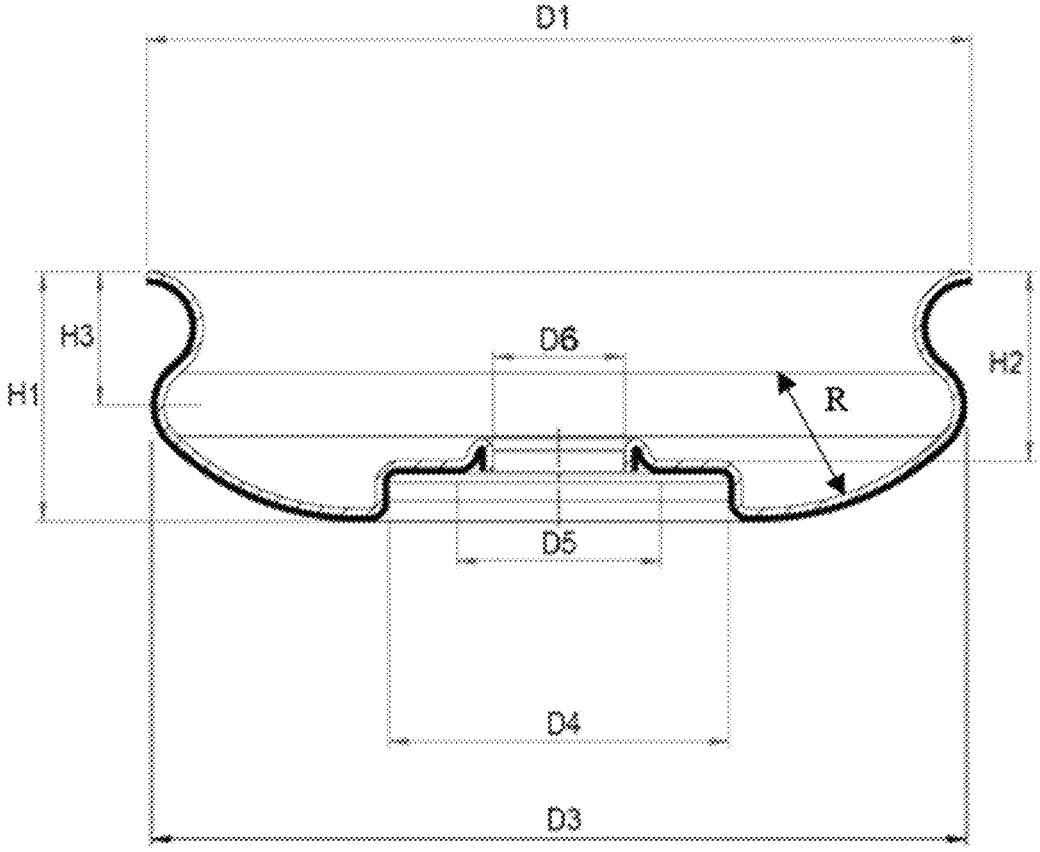

FIGS. 9A and 9B schematically illustrate a sectional view of a cup according to an alternative embodiment of the invention before flaring (FIG. 9A) and after flaring (FIG. 9B).

As illustrated in FIGS. 9A and 9B, the peripheral descending part 562 may include a concave outer face 502. In this way, the cup 50 better resists the pressure within the container 60. In addition, in the case of a cup 50 comprising a polymer material or made entirely of this material, vertical and radial reinforcing ribs on at least one of the faces of the cup, preferably the outer face 502, may be provided to reinforce the cup.

The concave outer face 502 may have a radius of curvature R of between 4 and 20 mm, preferably between 5 and 15 mm. Even if the central part 561 is slightly deformed when the cup 50 is attached to the container 60 and/or when the container 60 is pressurised, the angles between the different portions of the bottom wall 56 remain substantially identical. In particular, as shown in FIGS. 9A and 9B, the radius of curvature R of the peripheral descending part 562 remains substantially identical before and after flaring, which makes it possible to limit the loss of mechanical resistance to pressure within the container 60.

The cup may be defined by its dimensions, in particular the following dimensions:

- D1 External diameter of the cup 50, measured at the peripheral end of the deformable attachment area 51;
- D2 Diameter of the junction between the bearing edge 511 and the frustoconical part 512 of the deformable attachment area 51;
- D3 External diameter of the bottom wall 56;
- D4 External diameter of the planar wall 565;
- D5 Internal diameter of the planar wall 565;
- D6 Diameter of central opening 52;
- H1 Total height of the cup;
- H2 Distance between the top of the outer face of the deformable attachment area 51 and the top of the outer face of the peripheral descending part 562;
- H3 Distance between the top of the outer face of the deformable attachment area 51 and the top of the outer face of the deformable descending wall 513.

Dimension H1 is defined as the distance between the projection of the top of the outer face of the deformable attachment area 51 on the central axis A and the projection of the bottom of the inner face of the peripheral descending part 562 on the central axis A.

Dimension H2 is defined as the distance between the projection of the top of the outer face of the deformable attachment area 51 on the central axis A and the projection of the top of the outer face of the peripheral descending part 562 on the central axis A.

Dimension H3 is defined as the distance between the projection of the top of the outer face of the deformable attachment area 51 on the central axis A and the projection of the top of the outer face of the deformable descending wall 513 on the central axis A.

The table below shows exemplary dimensions:

| Exemplary dimensions in mm | |
|---|---|
| Dimensions | Exemplary ranges for cups FIG. 8A and 9A |
| D1 | 25.00-35.00 |
| D2 | 23.00-33.00 |
| D3 | 21.00-31.00 |
| D4 | 10.00-14.00 |
| D5 | 5.00-9.00 |
| D6 | 3.00-6.00 |
| H1 | 7.00-13.00 |
| H2 | 5.00-9.00 |
| H3 | 2.00-4.00 |

Due to the presence of the protection area, the values of dimensions D4, D5 and D6 remain substantially identical after flaring. In the same way, the angles of the different portions of the bottom wall remain substantially identical after flaring.

Figure 10:
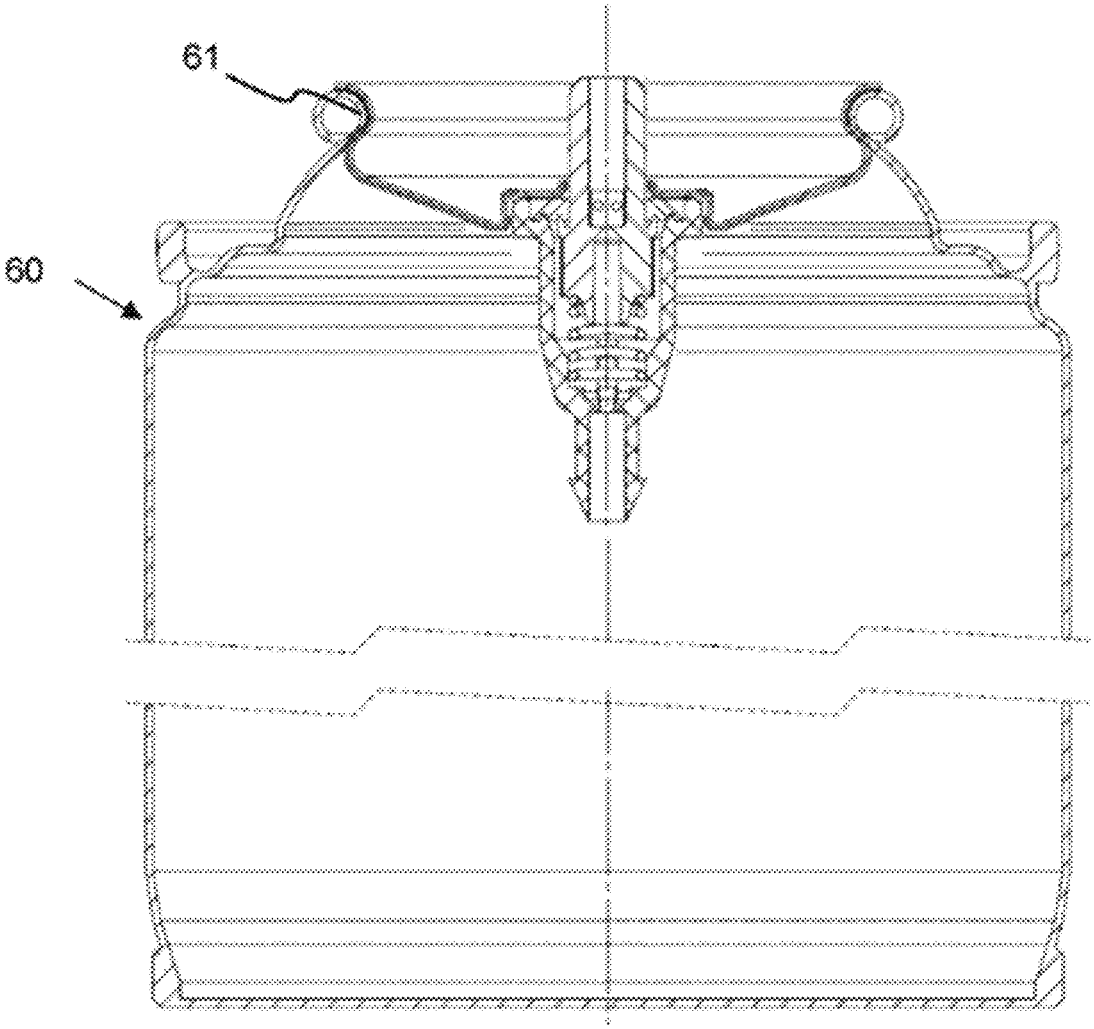
FIG. 10 illustrates a sectional view of the valve of FIG. 1 flared onto a container.

FIG. 10 schematically illustrates a sectional view of the valve of FIG. 1 attached onto a container by flaring.

The deformable attachment area 51 allows the cup to be placed onto the neck 61 of the container 60. The external diameter of the cup D1 may be greater than the diameter of the neck 61 so that the cup does not fall into the container 60. In the case of cups attached by flaring, the neck 61 of the container 60 is generally rolled and the deformable attachment area 51 surrounds the internal part of the neck 61. In this case, the deformable attachment area 51 substantially matches the shape of the neck, enveloping the internal part of the neck 61, as shown in FIG. 10.

Figure 11A:
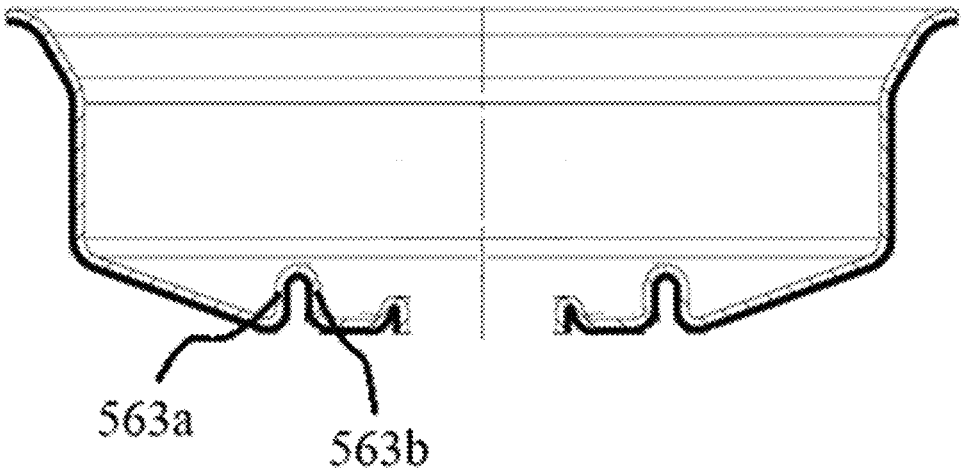
FIGS. 11A and 11B illustrate a sectional view of a cup according to two alternative embodiments of the invention.
Figure 11B:
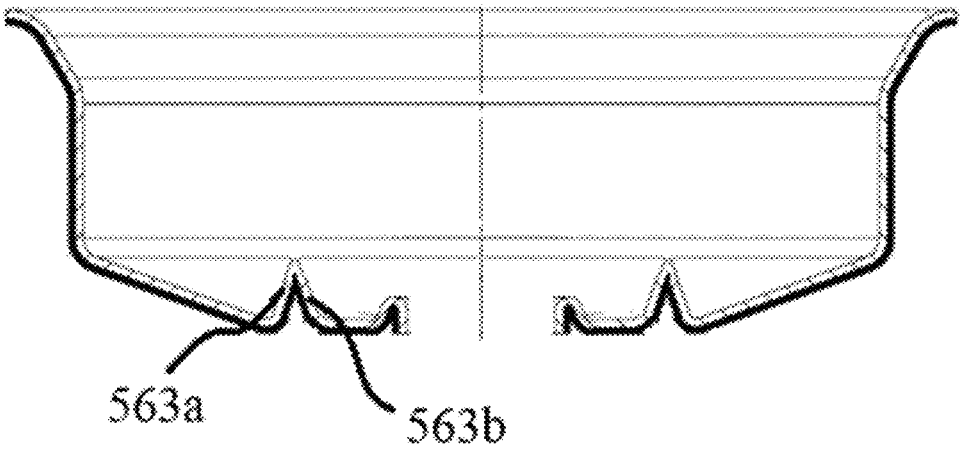

FIGS. 11A and 11B schematically illustrate a sectional view of a cup according to two alternative embodiments of the invention.

The rising and/or descending wall 563*a*, 563*b* may comprise a rising wall 563*a* followed by a descending wall 563*b*. The descending wall 563*b* can descend until it reaches the same axial position as that of the bottom of the rising wall 563*a*. The rising and/or descending wall 563*a*, 563*b* may be vertical as illustrated in FIG. 11A, or planar frustoconical as illustrated in FIG. 11B. The junction between the rising wall 563*a* and the descending wall 563*b* may be steep as shown in FIG. 11B.

Even if only one rising wall 563*a* and one descending wall 563*b* are illustrated in the embodiments of FIGS. 11A and 11B, those skilled in the art will understand that any number of sequential rising and/or descending walls 563*a*, 563*b* will enable effects similar to those mentioned above.

Figure 12A:
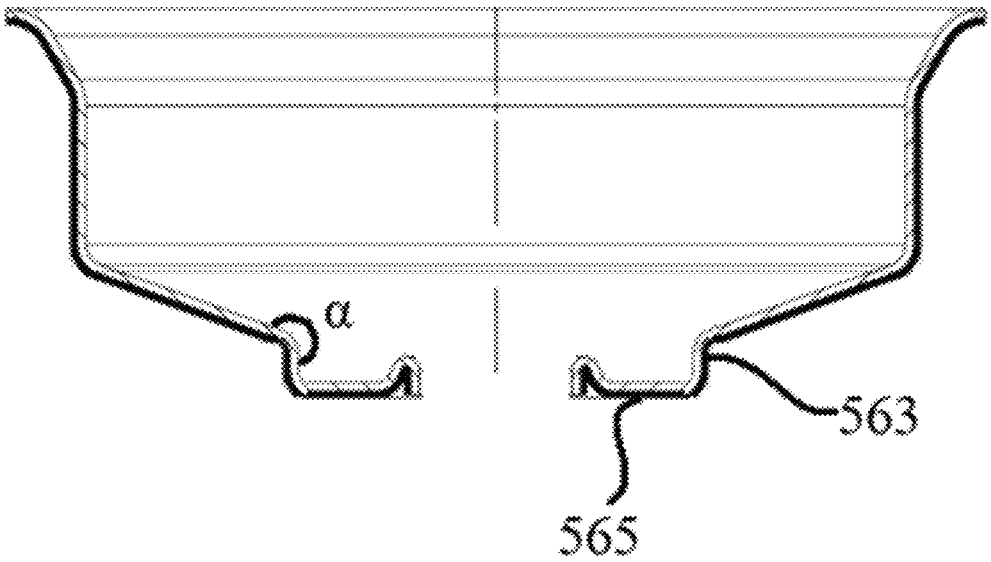
FIGS. 12A and 12B illustrate a sectional view of a cup according to two alternative embodiments of the invention.
Figure 12B:
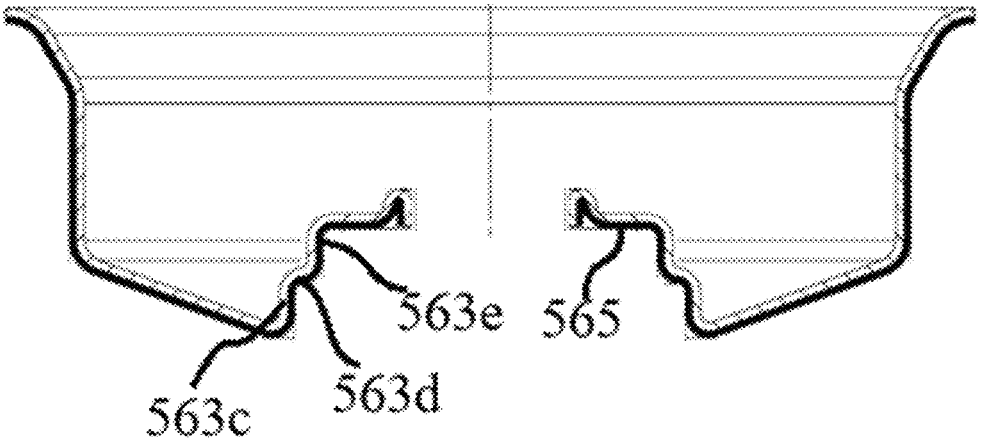

FIGS. 12A and 12B schematically illustrate a sectional view of a cup according to two alternative embodiments of the invention.

As explained above, the rising and/or descending wall 563 makes it possible on the one hand to isolate the central part 561 from the deformable attachment area 51, and on the other hand, it serves as a centering means for centering the valve body 10, particularly when attaching the crown 15 of the valve body 10 onto the inner face 501 of the planar wall (565) of the central part 561. These effects may be obtained by different combinations of rising and/or descending wall 563.

In a first embodiment, the rising and/or descending wall 563 corresponds to a descending wall 563 which protrudes from the peripheral descending part 562, as illustrated in FIG. 12A. The angle α between the peripheral descending part 562 and the descending wall 563, measured from the outer face's 502 side, may be less than 270°, preferably between 230° and 265°, more preferably between 240° and 260°. The descending wall 563 may be followed by a planar wall 565 including the central opening 52 and configured for receiving a valve body 10 on the inner face 501.

This embodiment offers the possibility, among other advantages, of attaching the attachment crown 15 of the valve body 10 when the radial dimension of the attachment crown 15 is greater than the radial dimension of the planar wall 565.

In a second embodiment, the rising and/or descending wall 563 comprises a first rising wall 563*c* which protrudes from the peripheral descending part 562, followed by a planar wall 563*d*, followed by a second rising wall 563*e* which protrudes from said planar wall 563*d*, as illustrated in FIG. 12B. The rising and/or descending wall 563 may be followed by a planar wall 565 including the central opening 52 and configured for receiving a valve body 10 on the inner face 501.

Those skilled in the art will understand that other non-described combinations of rising and/or descending walls will afford the advantages described above.

Figure 13A:
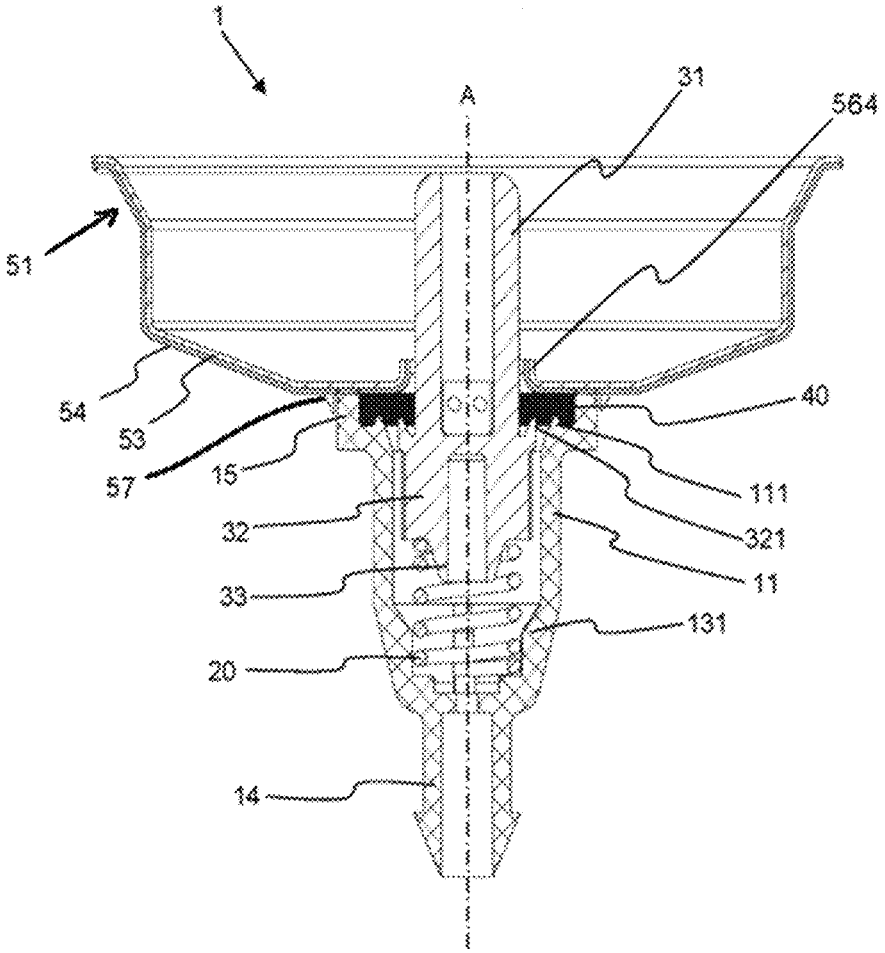
FIGS. 13A to 13C illustrate a sectional view of a male-type valve provided with a cup comprising a centering means.
Figure 13B:
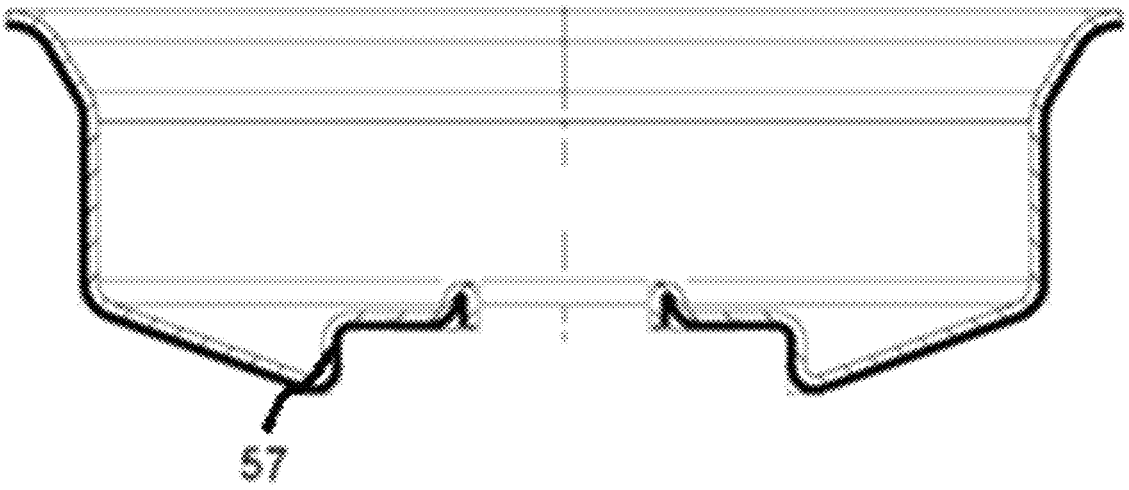
Figure 13C:
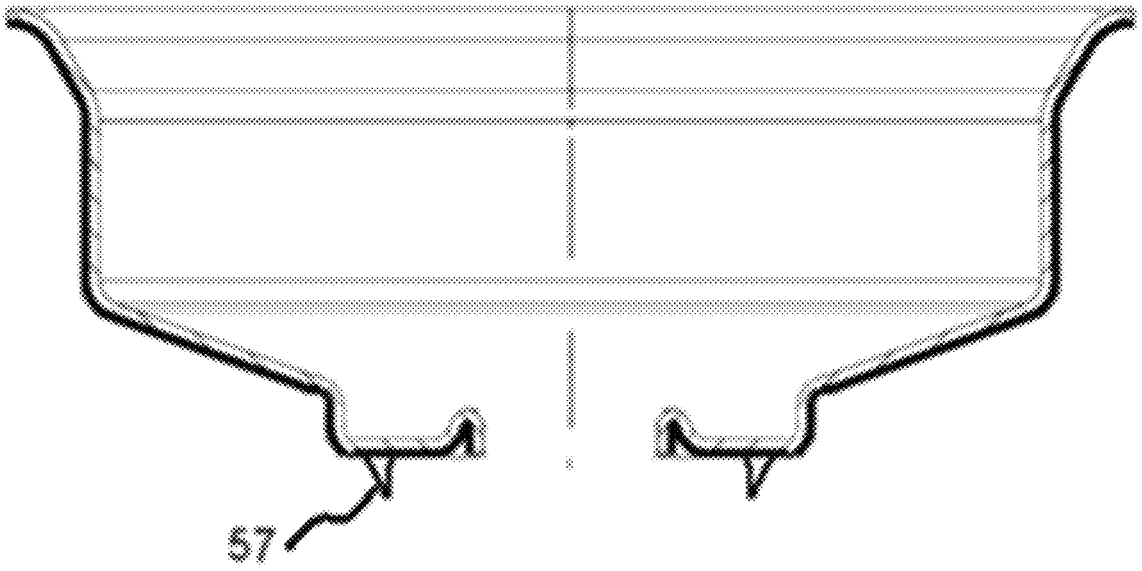

FIGS. 13A to 13C schematically illustrate a sectional view of a male-type valve provided with a cup comprising a centering means.

Similar components have been indicated by the same reference numerals as in previous embodiments and will not be described again.

As explained above with reference to FIGS. 3 and 4, the rising and/or descending wall 563 can serve as a centering means for centering the valve body 10, particularly when attaching the crown 15 of the valve body 10 onto the inner face 501 of the planar wall 565 of the central part 561.

Alternatively or additionally, with reference to FIGS. 13A to 13C, the central part 561 may be provided with a centering means 57 configured for allowing the centering of a valve body 10 when attaching the valve body 10 onto the inner face 501 of the central part 561, providing the same centering effect as that described in relation to the previous embodiments.

As illustrated in FIGS. 13B and 13C, the centering means 57 may be combined with the cups of all the previous embodiments, for example with a cup comprising a rising wall (FIG. 13B) or with a cup comprising a descending wall (FIG. 13C).

The centering means 57 may correspond to a continuous peripheral wall formed in the central part 561. As illustrated in FIGS. 13A and 13C, the centering means 57 may correspond to a peripheral protrusion oriented downwards from the central part 561. The radial distance between the centering means 57 and the main axis A may be greater, by preferably no more than a few millimetres, than the radial distance between the end of the attachment crown 15 and the main axis A, so that the centering means 57 surrounds the attachment crown 15 when the valve body 10 is attached to the inner face 501 of the central part 561.

Alternatively, the centering means 57 may be composed of a plurality of spaced apart protrusions, which saves material by reducing the number of protrusions and/or their dimensions.

The central part 561 may be provided with a planar wall 565 including the central opening 52 and surrounded by the centering means 57, configured for receiving a valve body 10 on the inner face 501.

The centering means 57 may be a protection area configured for limiting the deformation of the central part during the deformation of the deformable attachment area of the cup for attaching the cup onto the container. As illustrated in FIG. 13B, the centering means 57 may be a rising wall which protrudes from the peripheral descending part 562. The rising wall serves on the one hand as a protection area by isolating the central part 561 from the area of deformable attachment area 51, and on the other hand, it serves as a centering means 57 for centering the valve body 10. Indeed, the valve body 10 can occupy the space of the cavity defined by the rising wall 563 and the part central 561 of the bottom wall 56 towards the inner face 501 so as to be centred before being attached to the valve cup 50.

The height of the centering means 57, defined as the distance between the top of the centering means 57 and the base of the centering means 57, may be less than the height of the attachment crown 15.

Although the principles of the invention have been set forth above in relation to specific embodiments, it should be understood that this description is merely by way of example and does not constitute a limitation of the scope of protection which is determined by the appended claims below.

LIST OF REFERENCES

1 Valve according to the invention
10 Valve body
11 Tubular body
111 Tapered edge
112 Through-opening
12 Bottom wall
121 Inlet
13 Internal chamber
131 Vertical ribs
14 Stud
15 Attachment crown
151 Transverse wall
152 Annular border of the attachment crown
152*a* Extra thickness of material for welding
152*b* Extra thickness of material for welding
20 Spring
30 Stem
31 Cylindrical wall
311 Lower end
312 Holes
32 Crown
321 Sealing rib
33 Spring guide stud
40 Valve seal
50 Cup
501 Cup inner face
502 Cup outer face
503 Cavity in the outer face of the cup
51 Deformable attachment area
511 Peripheral bearing edge
512 Frustoconical part
513 Deformable descending wall
52 Central opening
53 Metallic outer layer
54 Polymer inner layer
56 Bottom wall
561 Central part around the central opening
562 Peripheral descending part
563 Rising and/or descending wall
564 Rolled central edge
565 Planar wall

566 Bend
57 Centering means
60 Container
61 Neck
A Main axis
D1 External diameter of the cup
D2 Diameter of the junction between the bearing edge 511 and the frustoconical part 512 of the deformable attachment area 51
D3 Maximum diameter of the peripheral descending part 562
D4 Maximum diameter of the planar wall 565
D5 Minimum diameter of the planar wall 565
D6 Internal diameter of central opening 52
H1 Total height of the cup
H2 Distance between the top of the deformable attachment area 51 and the top of the peripheral descending part 562
H3 Distance between the top of the deformable attachment area and the top of the deformable descending wall 513
R Radius of curvature of the peripheral descending part 562
α Angle between the peripheral descending part 562 and the rising and/or descending wall 563
β Angle between the rolled central edge 564 and the planar wall 565
γ Angle between the planar wall 565 and the rising and/or descending wall 563
δ Descent angle of the peripheral descending part 562

The invention claimed is:

1. A valve cup for a pressure container, having an inner face turned towards an inside of the container, and an outer face, the cup being provided with:

a peripheral deformable attachment area configured for attaching the cup onto the container, a central opening configured for allowing passage of a product outlet rod, and a bottom wall which surrounds the central opening and comprises a peripheral descending part and a central part, wherein the central part is provided with a protection area configured for limiting the deformation of the central part during the deformation of the deformable attachment area of the cup for attaching the cup onto the container, wherein the bottom wall comprises a turned-up edge forming a rolled edge surrounding the central opening, and wherein the rolled edge is rolled up a first time in a direction of the outer face of the cup, and a second time in a direction of the inner face of the cup.

2. The valve cup according to claim 1, wherein the central part is provided with a planar wall surrounded by the protection area, including the central opening and configured for receiving a valve body on the inner face.

3. The valve cup according to claim 2, wherein the bottom wall comprises a turned-up edge forming a rolled edge surrounding the central opening, and wherein the edge forms an angle (B) of between 70° and 110° with respect to the planar wall.

4. The valve cup according to claim 2, wherein the protection area comprises a rising and/or descending wall which protrudes from the peripheral descending part, and wherein the planar wall forms an angle (γ) of between 70° and 110° with respect to the rising and/or descending wall.

5. The valve cup according to claim 1, wherein the deformable attachment area comprises a deformable descending wall and a bearing edge.

6. The valve cup according to claim 1, wherein the protection area comprises a rising and/or descending wall which protrudes from the peripheral descending part.

7. The valve cup according to claim 6, wherein a height of the peripheral descending part is greater than a height of the rising and/or descending wall.

8. The valve cup according to claim 6, wherein the bottom wall comprises a bend between the peripheral descending part and the rising and/or descending wall.

9. The valve cup according to claim 6, wherein the rising and/or descending wall is a rising wall, and in that an angle (α) between the peripheral descending part and the rising wall is less than 90°.

10. The valve cup according to claim 1, wherein the peripheral descending part comprises a concave outer face.

11. The valve cup according to claim 1, wherein the peripheral descending part comprises a planar frustoconical outer face.

12. The valve cup according to claim 1, wherein the deformable attachment area has a height at least three times greater than a height of the peripheral descending part.

13. The valve cup according to claim 1, wherein an end of the deformable attachment area is horizontal.

14. The valve cup according to claim 1, wherein the deformable attachment area comprises a frustoconical part.

15. A valve consisting of a cup according to claim 1, and a valve body with a product outlet rod, the valve body being attached to the inner face of the cup, with the rod passing through the central opening of the cup.

16. The valve according to claim 15, wherein the valve body is welded or glued to the inner face of the central part of the bottom wall.

17. The valve according to claim 15, wherein the valve body comprises a spring, an obturator and a valve seal.

* * * * *